United States Patent [19]

Swanson et al.

[11] Patent Number: 5,068,639

[45] Date of Patent: Nov. 26, 1991

[54] WALL BOX DIMMER

[75] Inventors: Dail L. Swanson, Danville, Ill.; Raymond M. Green, Richardson, Tex.; Gregory S. Bennorth, Champaign, Ill.

[73] Assignee: Valmont Industries, Inc., Valley, Nebr.

[21] Appl. No.: 543,448

[22] Filed: Jun. 25, 1990

[51] Int. Cl.[5] ..... H01C 10/38

[52] U.S. Cl. ..... 338/179; 338/178; 200/335; 200/252

[58] Field of Search ..... 338/178, 179, 172; 200/297, 310, 252, 335, 242; 220/159, 156, 307, 241; 174/66, 67

[56] References Cited

U.S. PATENT DOCUMENTS

| | | | |
|---|---|---|---|
| 3,746,923 | 7/1973 | Spira et al. | 338/179 X |
| 4,520,306 | 5/1985 | Kirby | 323/324 |
| 4,564,801 | 1/1986 | Kirby | 323/324 |
| 4,646,203 | 2/1987 | Ngo et al. | 361/388 |
| 4,695,820 | 9/1987 | D'Aleo | 338/179 |
| 4,733,330 | 3/1988 | Tanaka et al. | 200/297 X |
| 4,833,277 | 5/1989 | Jacoby, Jr. et al. | 174/66 |

*Primary Examiner*—Marvin M. Lateef
*Attorney, Agent, or Firm*—Zarley McKee Thomte Voorhees & Sease

[57] ABSTRACT

A wall box dimmer has a face plate having a pair of integral stand-offs extending rearwardly therefrom upon which is mounted a mounting strap. A circuit board is mounted on the rearward ends of the stand-offs. A back box is selectively removably secured to the mounting strap and covers the circuit board and circuit components.

6 Claims, 3 Drawing Sheets

WALL BOX DIMMER

BACKGROUND OF THE INVENTION

This invention relates to a wall box dimmer and more particularly to a wall box dimmer having features which facilitate ease of assembly.

Wall box dimmers are normally mounted in a wall and are used to control the dimming of the associated light. The conventional dimmers normally include a rheostat or a slide potentiometer.

The conventional wall box dimmers normally comprise a face plate having a mounting strap secured thereto by screws or rivets. The conventional dimmers also include a circuit board which is normally positioned by some means rearwardly of the mounting strap. The switch mechanism in the prior art dimmers is normally enclosed by a back box or switch box which is riveted or screwed to the mounting strap. The prior art devices are costly to manufacture and are costly to assemble.

It is therefore a principal object of the invention to provide an improved wall box dimmer.

Still another object of the invention is to provide a wall box dimmer including a face plate having at least a pair of integral stand-offs extending rearwardly therefrom upon which are mounted the mounting strap and circuit board.

Still another object of the invention is to provide a wall box dimmer which is less costly to assemble than the prior art devices.

These and other objects will be apparent to those skilled in the art.

SUMMARY OF THE INVENTION

Figure 1:
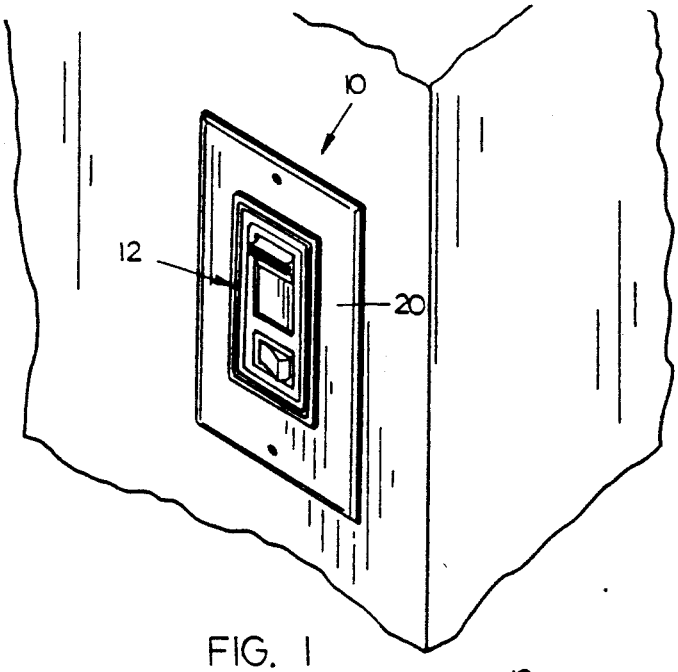
FIG. 1 is a perspective view illustrating the wall box dimmer of this invention mounted on a wall.
Figure 2:
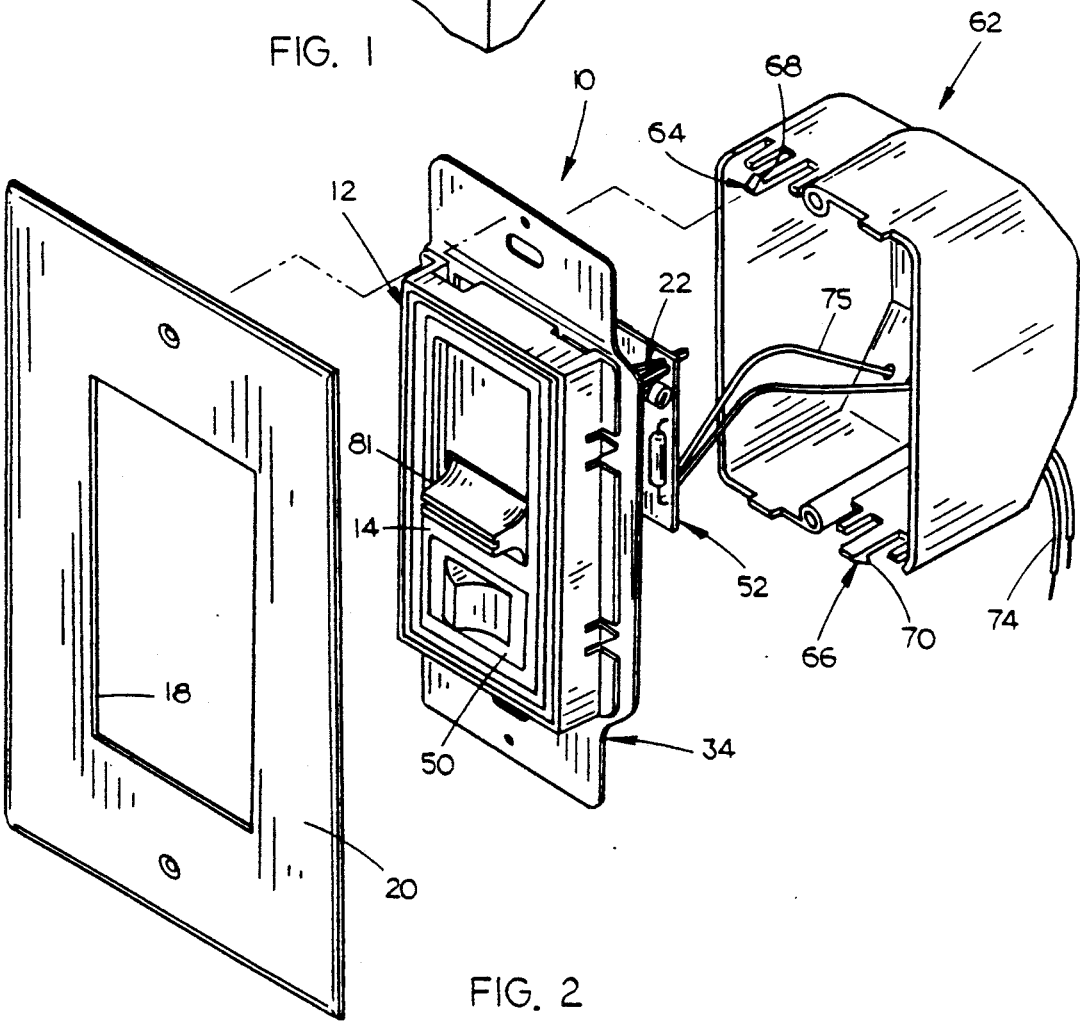
FIG. 2 is an exploded perspective view of the wall box dimmer of this invention.

The wall box dimmer of this invention comprises a face plate having a vertically movable knob provided thereon as well as a rocker switch. A pair of integrally formed stand-offs extend rearwardly from the rearward side of the face plate. An aluminum mounting strap is positioned rearwardly of the face plate and has a pair of openings formed therein which receive the stand-offs of the face plate. The stand-offs include means for maintaining the mounting strap closely adjacent the rearward face of the face plate. A circuit board is mounted on the rearward ends of the stand-offs in a spaced and secure relationship with respect to the mounting strap. A back box or switch box is removably secured to the mounting strap by a pair of latching members. The wall box dimmer of this invention is quickly and easily assembled and does not require the screws and rivets of the prior art devices to assemble the same.

DESCRIPTION OF THE PREFERRED EMBODIMENT

The wall box dimmer of this invention is referred to generally by the reference numeral 10 and includes a face plate 12 having a forward end 14 and a rearward end 16. Face plate 12 is adapted to be positioned in an opening 18 of a wall plate or cover plate 20.

Figure 3:
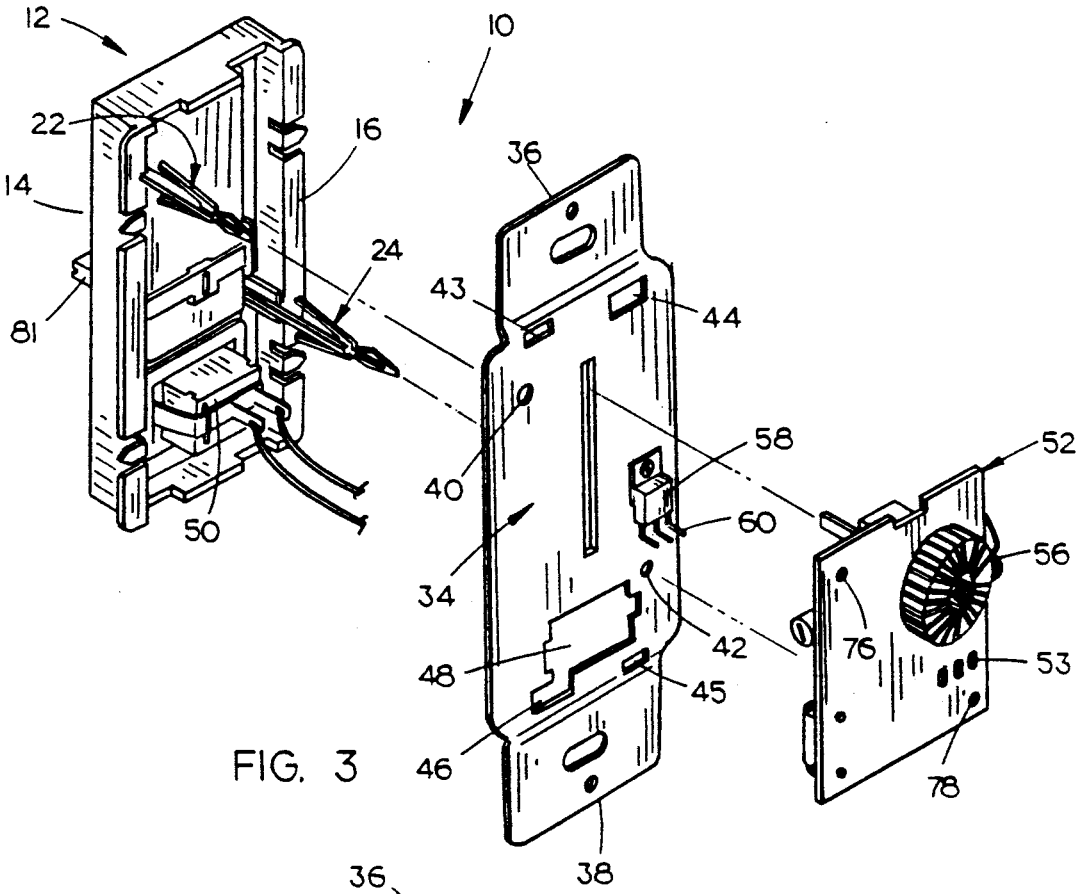
FIG. 3 is an exploded perspective view of a portion of the wall box dimmer.

Face plate 12 includes a pair of integrally formed stand-offs 22 and 24 which extend rearwardly therefrom as seen in FIG. 3. Each of the stand-offs 22 and 24 is provided with a pair of resilient arms 26 and 28 (FIG. 4) which extend forwardly and outwardly from shoulder 30 which is located forwardly of the rearward end of the stand-off.

The numeral 34 refers to an aluminum mounting strap having an upper end 36 and a lower end 38. Mounting strap 34 is provided with a pair of openings 40 and 42 formed therein which are adapted to receive the stand-offs 22 and 24 extending therethrough respectively. Mounting strap 34 is also provided with a pair of rectangular openings 43 and 44 formed therein at the upper end thereof and a pair of rectangular openings 45 and 46 formed therein at the lower end thereof for a purpose to be described in more detail hereinafter. Mounting strap 34 is also provided with an opening 48 formed therein which receives the rearward end of rocker switch 50 which is mounted in face plate 12.

The numeral 52 refers generally to a conventional circuit board having the various circuit components mounted thereon such as a slide potentiometer 54 and choke 56. A conventional triac 58 is mounted on the rearward surface of mounting strap 34 by a rivet or the like and includes a plurality of terminals 60 extending rearwardly therefrom which are adapted to be received by openings 53 in the circuit board 52 and hand soldered thereto as will be described in more detail hereinafter.

Figure 6:
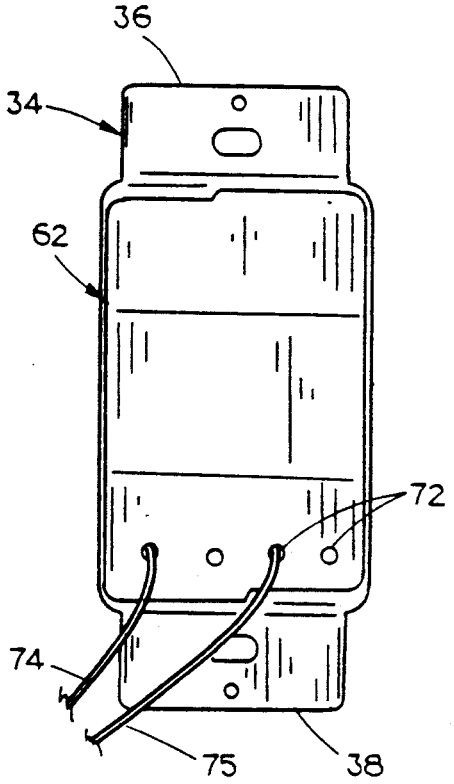
FIG. 6 is a back view of the dimmer.

The numeral 62 refers to a back box or switch box which is designed to be secured to mounting strap 34 so as to cover the circuit board and the components associated therewith. Box 62 has a pair of latch arms 64 and 66 extending forwardly therefrom which have tapered shoulders 68 and 70 provided at the forward ends thereof which are adapted to extend through the rectangular openings 44 and 46 respectively in mounting strap 34 to removably secure the back box 62 to the mounting strap 34. Guide lugs 67 and 69 also extend forwardly from back box 62 and are designed to be received by the openings 43 and 45 respectively. The use of the latch arms 64 and 66 eliminates the need for screwing or riveting the back box 62 to the mounting strap 34 and therefore simplifies the ease of assembly. As seen in FIG. 6, back box 62 is provided with a plurality of openings 72 formed therein to permit leads 74 and 75 to extend outwardly therethrough.

Figure 4:
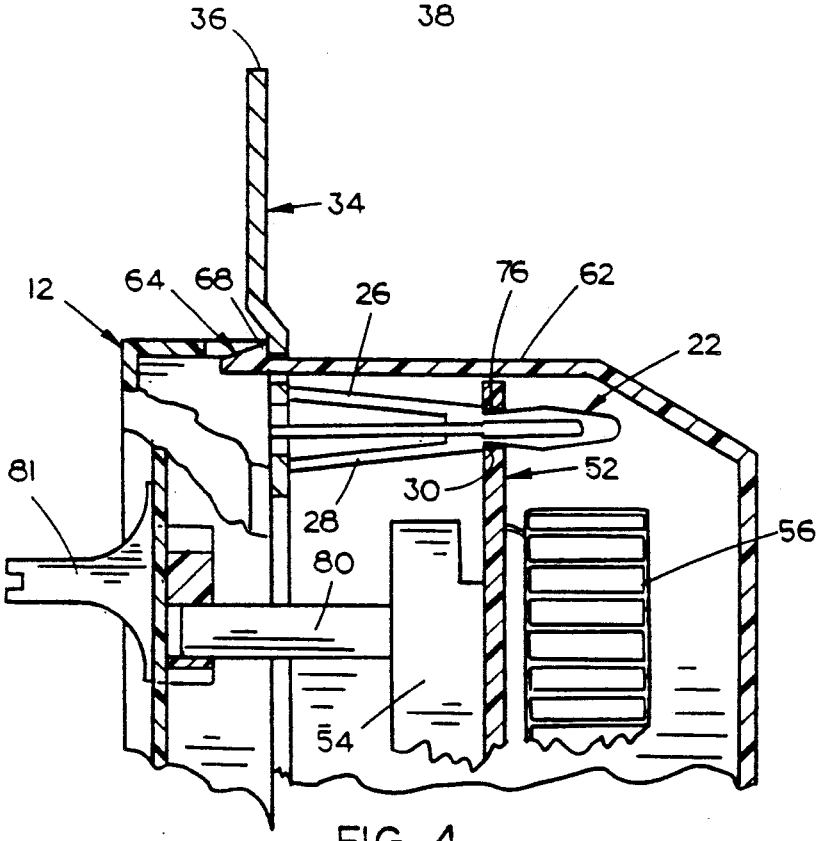
FIG. 4 is a partial sectional view illustrating the manner in which certain components of the dimmer are secured together.
Figure 5:
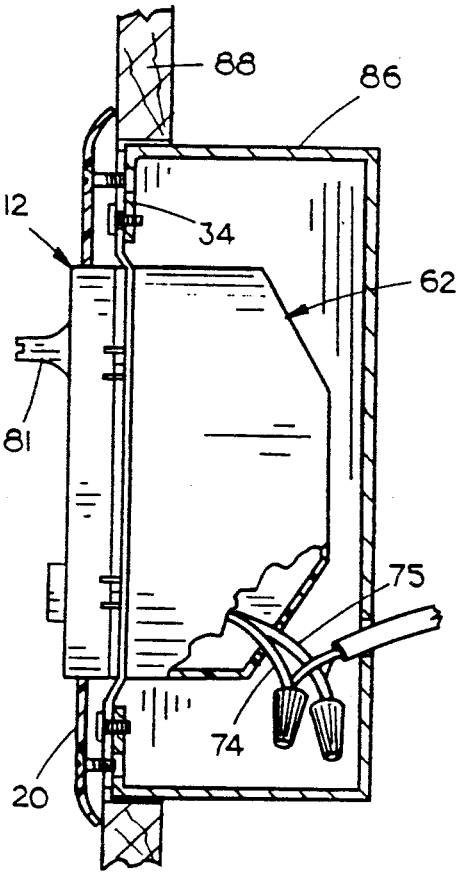
FIG. 5 is a partial vertical sectional view of the dimmer.

The wall box dimmer of this invention is assembled as follows. Triac 58 is secured to mounting strap 34 by a pop rivet or the like. Mounting strap 34 is positioned adjacent the rearward surface 16 of face plate 12 by causing the stand-offs 22 and 24 to extend through the openings 40 and 42 respectively. The resilient arms 26 and 28 on each of the stand-offs 22 and 24 initially deflect inwardly to pass through the openings 40 and 42 and then move outwardly once the forward ends thereof are positioned rearwardly of strap 34 so that the mounting strap 34 is maintained in close proximity to the rearward end of the face plate 12 as seen in FIG. 4. When the mounting strap 34 is so positioned, the rearward end of the rocker switch 50 extends through the opening 48 in mounting strap 34.

Figure 7:
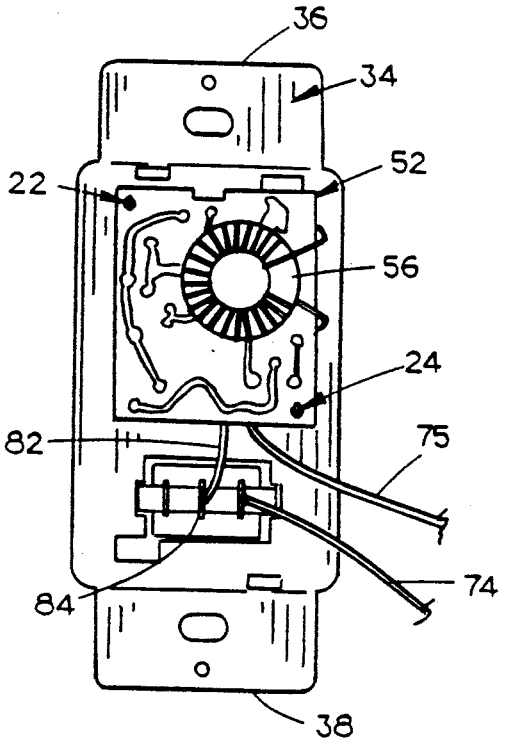
FIG. 7 is a back view of the dimmer prior to the back box being mounted thereon.
Figure 8:
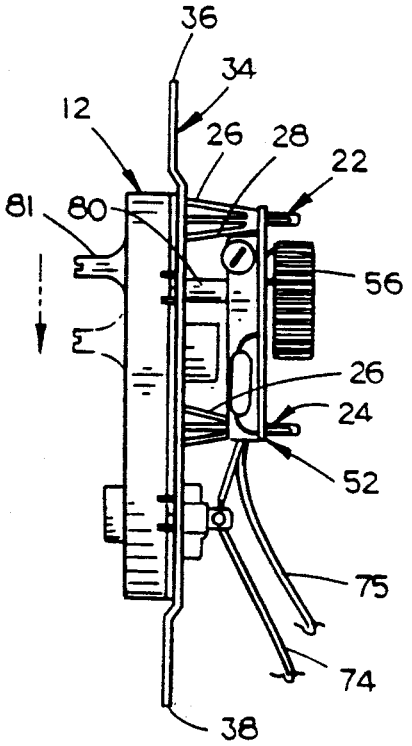
FIG. 8 is a side view of the assembly of FIG. 7.

The circuit board 52 is then secured to the mounting strap 34 by causing the rearward ends of the stand-offs 22 and 24 to extend through the openings 76 and 78 formed in circuit board 52 The circuit board 52 is press-fitted onto the rearward ends of the stand-offs 22 and 24 so that the circuit board will be maintained in a spaced and secure relationship with respect to the mounting strap 34. When the circuit board is so positioned, the slide arm 80, which is connected to the dimmer knob 81, engages potentiometer 54 to control the operation of the slide potentiometer 54 through vertical slidable movement of the dimmer knob 81 as seen in FIG. 4. Triac leads 60 pass through holes 53 and are subsequently soldered to the circuit board 52. Lead 82, which extends from the circuit board 52, is soldered to terminal 84 on rocker switch 50 and lead 74 is soldered to terminal 88 on the rocker switch 50. Lead 75 also extends from the circuit board 52 as seen in FIG. 7.

The leads 74 and 75 are extended through the openings 72 in back box 62 and the back box 62 is then secured to mounting strap 34 as previously described. The assembly is then secured to the conventional wall box positioned in the wall 88 in conventional fashion. The cover plate 20 is then positioned over the face plate to cover the wall box and the opening in the wall. Dimmer switch 81 permits the selective dimming of the associated light while switch 50 serves as an on/off switch.

Thus it can be seen that a novel wall box dimmer has been provided which is easily assembled and which includes means to reduce or eliminate the need for rivets, screws, etc. which would normally be required to secure the face plate to the mounting strap and for securing the back box to the mounting strap. Thus it can be seen that the invention accomplishes at least all of its stated objectives.

We claim:

1. A wall box dimmer comprising, a face plate having front and rear surfaces, upper and lower ends, and opposite side edges, said face plate having at least a pair of stand-offs extending rearwardly from the rear surface thereof, a substantially flat mounting strap positioned rearwardly of said rear surface of said face plate and having upper and lower ends positioned above the upper and lower ends of said face plate, respectively, said mounting strap having a pair of openings formed therein which receive said stand-offs, said stand-offs including resilient arms diverging outwardly and forwardly, and having forward free ends, which are deflected towards one another as the standoffs are inserted through the respective openings in the mounting strap, and which move outwardly when inserted past their forward ends through said mounting strap openings for maintaining said mounting strap closely adjacent the rear surface of said face plate, a circuit board means mounted on said stand-offs rearwardly of said mounting strap and in a fixed and spaced relationship with respect thereto, a rheostat means on said circuit board means includes a slide means, said mounting strap having a slot formed therein through which said rheostat slide means projects for slidable movement;

a dimmer knob movably mounted on said face plate and having a slide arm extending rearwardly therefrom which is operatively connected to the rheostat slide means for selective movement of the same, and an on-off switch means mounted on said face plate.

2. The dimmer of claim 1 wherein said stand-offs are integrally formed with said face plate.

3. The dimmer of claim 1 wherein said circuit board means has a pair of openings formed therein and wherein said stand-offs are press-fitted into said openings in said circuit board means.

4. The dimmer of claim 1 wherein a back box is selectively removably secured to said mounting strap and extends around said circuit board means.

5. The dimmer of claim 4 wherein said mounting strap has at least a pair of box mounting openings formed therein, said back box having a pair of forwardly projecting attachment arms extending therefrom which are adapted to be received by said box mounting openings to selectively removably secure said back box to said mounting strap.

6. The dimmer of claim 3 wherein the rearward ends of stand-offs have shoulder means provided thereon for limiting the forward movement of said circuit board means relative to said stand-offs and said mounting strap.

* * * * *